US007088316B2

(12) United States Patent
Kao et al.

(10) Patent No.: US 7,088,316 B2
(45) Date of Patent: Aug. 8, 2006

(54) COLOR ADJUSTMENT DEVICE AND METHOD FOR PLASMA DISPLAY PANEL

(75) Inventors: Hsu-Pin Kao, Taoyuan Hsien (TW); Yi-Chia Shan, Taoyuan Hsien (TW); Chun-Hsu Lin, Taipei Hsien (TW); Yi-Sheng Yu, Taoyuan Hsien (TW)

(73) Assignee: Chunghwa PIcture Tube, Ltd., Taipei (TW)

( * ) Notice: Subject to any disclaimer, the term of this patent is extended or adjusted under 35 U.S.C. 154(b) by 152 days.

(21) Appl. No.: 10/064,613

(22) Filed: Jul. 31, 2002

(65) Prior Publication Data

US 2003/0174104 A1 Sep. 18, 2003

(30) Foreign Application Priority Data

Mar. 18, 2002 (TW) ..... 91105036 A

(51) Int. Cl.
*G09G 5/02* (2006.01)
*G09G 5/10* (2006.01)
*G09G 3/28* (2006.01)

(52) U.S. Cl. ..... 345/72; 345/68; 345/600; 345/601; 345/690

(58) Field of Classification Search ..... 345/60, 345/63, 72, 589, 590, 596, 600, 601, 690; 358/3.03–3.05, 1.9
See application file for complete search history.

(56) References Cited

U.S. PATENT DOCUMENTS

| | | | | |
|---|---|---|---|---|
| 6,069,609 | A * | 5/2000 | Ishida et al. | 345/596 |
| 6,069,610 | A * | 5/2000 | Denda et al. | 345/694 |
| 6,088,009 | A * | 7/2000 | Moon | 345/60 |
| 6,473,091 | B1 * | 10/2002 | Iida et al. | 345/589 |
| 6,486,859 | B1 * | 11/2002 | Croll et al. | 345/72 |
| 6,671,068 | B1 * | 12/2003 | Chang et al. | 382/252 |
| 2002/0015010 | A1 * | 2/2002 | Takahashi | 345/60 |
| 2002/0027566 | A1 * | 3/2002 | Naka et al. | 345/696 |
| 2002/0067510 | A1 * | 6/2002 | Kempf | 358/3.03 |
| 2002/0135595 | A1 * | 9/2002 | Morita et al. | 345/589 |
| 2003/0038953 | A1 * | 2/2003 | Damera-Venkata | 358/1.9 |
| 2003/0231148 | A1 * | 12/2003 | Lin et al. | 345/63 |

* cited by examiner

*Primary Examiner*—Bipin Shalwala
*Assistant Examiner*—David L. Lewis
(74) *Attorney, Agent, or Firm*—Jianq Chyun IP Office

(57) ABSTRACT

A color adjustment device and method for the plasma display panel. The color adjustment device comprises a look up table and an error diffusion circuit. Wherein, the look up table is used to store a plurality of gray scale data, select one corresponding data from the plurality of gray scale data according to a received gray scale input value as an output. The error diffusion circuit receives the gray scale data output from the look up table, and achieves the objective of improving the color adjustment precision by using an error diffusion compensation method.

12 Claims, 4 Drawing Sheets

COLOR ADJUSTMENT DEVICE AND METHOD FOR PLASMA DISPLAY PANEL

CROSS REFERENCE TO RELATED APPLICATIONS

This application claims the priority benefit of Taiwan application Ser. No. 91105036, filed Mar. 18, 2002.

BACKGROUND OF INVENTION

1. Field of Invention

The present invention generally relates to a color adjustment device and method, and more particularly, to a color adjustment device and method for the plasma display panel.

2. Description of Related Art

Generally speaking, display devices can be divided into two categories, one is the display using the cathode ray tube, the other is the flat panel display. Since the flat panel display is lighter, thinner and easier to carry compared to the display using the cathode ray tube, and the consumed power is much less than the display using the cathode ray tube, the flat panel display has started to replace the display using the cathode ray tube and is gradually becoming the user favorite.

Familiar flat panel displays in the current market are the liquid crystal display (LCD) and the plasma display panel (PDP). Since the plasma display panel can be manufactured as a big area display panel, it is commonly used as a television display interface. However, the color expression and the brightness ratio of the red, green, blue tricolor fluorescence used by the plasma display panel are variant, and do not accord with the NTSC specification that is commonly used by the television signals. Therefore, the plasma display panel can not truly express the real color that the video intends to present when it receives the video signals. Therefore, in order to have the plasma display panel express the accurate color, it is necessary to adequately adjust the gain value of each primitive color. For example, if the plasma display panel having the characteristics as shown in following table 1 is used to display a white color signal that accords with the NTSC specification, the color displayed by the plasma display panel has a difference, as shown in table 2, when compared to the color of the original white color signal.

The ratio of each primitive color has a great probability of being a non-integer ratio. For example, if the plasma display panel having the characteristics as shown in table 1 is used to display the white color signal having the Red gray scale: Green gray scale: Blue gray scale=1:1:1, the signal ratio has to be adjusted to Red gray scale: Green gray scale: Blue gray scale=1:0.88:0.985, so that the white color light that accords with the NTSC specification as shown in table 2 can be obtained. However, the pattern generator that is generally used only performs the input and output of the gray scale value for the integer, and can not deal with the input and output of the gray scale in the decimal portion. Therefore, in the prior art, when the display is adjusted, the decimal portion of the gray scale value can only be processed by the truncation or the carry method, so that the closest color can be chosen for further processing. Since the precision of the gray scale in the decimal portion is lost, the precise adjustment result can not be obtained.

TABLE 1

| | x | Y | Y(cd/m$^2$) |
|---|---|---|---|
| Red | 0.636 | 0.352 | 129 |
| Green | 0.236 | 0.705 | 269 |
| Blue | 0.163 | 0.091 | 59 |

TABLE 2

| | x | y | Color Temperature (K) | Color Distortion (duv) |
|---|---|---|---|---|
| NTSC (White) | 0.31 | 0.316 | 6500 | 0 |
| Plasma Display Panel Color | 0.307 | 0.328 | 6820 | 0.006 |

Note.
x, y is the color coordinate of CIE

SUMMARY OF INVENTION

The present invention provides a color adjustment device and method for the plasma display panel. The input value of the gray scale is converted to a gray scale value having a bigger number, then these gray scale figures are used to adjust a brightness output error that is within a predetermined range by using an error diffusion method. With this, the color of the plasma display panel can be adjusted according to the variant parameters that are predetermined in advance, so that the variant precisions can be obtained and the color expression of the plasma display panel can be improved.

The present invention provides a color adjustment device for the plasma display panel. The color adjustment device comprises a Look Up Table (LUT) and an Error Diffusion Circuit. Wherein, the look up table stores a plurality of gray scale data, and extracts one corresponding data from these gray scale data as an output according to the received gray scale input value. The error diffusion circuit receives the gray scale data output from the look up table, and achieves the objective of improving the precision of the color adjustment by using the error diffusion compensation method.

In a preferred embodiment of the present invention, the error diffusion circuit mentioned above consists of at least an operation and discriminance unit, an adder, a multiplier, a subtractor, and an error value provision device. Wherein, the error value provision device provides an error value to the adder, so that the gray scale data provided by the look up table and this error value can perform an add operation in the adder. The result of the add operation from the adder is output to the operation and discriminance unit, the operation and discriminance unit divides the received data by a predetermined value to obtain a quotient, and finally outputs the integer portion of this quotient. The multiplier multiplies the integer portion of the quotient by the predetermined value mentioned above and outputs the result. The subtractor receives the output from the multiplier, subtracts the output of the multiplier from the first data. Afterwards, the subtractor outputs the data after the subtraction to the error value provision device.

In the other embodiment of the present invention, the error value provision device mentioned above comprises a memory device and a weighting element. Wherein, the memory device stores the data output from the subtractor, and outputs a portion of stored data that corresponds to the pixel related to the next display pixel. The weighting element performs a weighting operation onto the data output from the memory device to obtain the error value mentioned above and provides the error value to the adder.

Moreover, the present invention further provides a color adjustment method for the plasma display panel. In the color adjustment method disclosed by the present invention, at first, after receiving a gray scale input value of an integer, magnifying the gray scale input value to a corresponding gray scale data. In the further error diffusion adjustment, the gray scale data is used to adjust a brightness display that is within a specific range. Wherein, the gray scale input value has a one-to-one relationship with the gray scale data. If the gray scale data has N integers and the brightness range to be adjusted has M integers, then N>M.

In a preferred embodiment of the present invention, the gray scale input value differs from the corresponding gray scale data by a predetermined integer value. In another preferred embodiment of the present invention, this relationship can be implemented by a build-in look up table. Moreover, in a further preferred embodiment of the present invention, the process to adjust the brightness display according to the gray scale data mentioned above comprises the following steps: obtaining an error value that is given by the error store value contiguous to the pixel multiplied by the weighting value. Afterwards, the summation of the gray scale data and the error value is divided by a predetermined value to obtain an integer portion of the quotient from this division operation. The integer portion is used as the brightness for the display. On the other hand, the integer portion of the quotient from this division operation is multiplied by the predetermined value, and then is subtracted from the gray scale data, and the result of the subtraction operation is subsequently saved. The value is the error store value of the pixel that currently displays.

In summary, the present invention adjusts the color precision by using the gray scale data and the brightness that have two different value ranges. Since the value range of the gray scale data is greater than the value range of the brightness, when the gray scale data is converted into the brightness, although only the integer portion can be output normally onto the pixel, the decimal portion that is obtained from the conversion process can also be added onto the display of the pixel contiguous to the pixel by using the error diffusion method. Therefore, under an even effect of the pixels having enough large area, the color precision is more precise than the one in the prior art that only uses the integer portion. Moreover, the color expression of the display adjusted by the present method is much better than the one in the prior art.

BRIEF DESCRIPTION OF DRAWINGS

The accompanying drawings are included to provide a further understanding of the invention, and are incorporated in and constitute a part of this specification. The drawings illustrate embodiments of the invention, and together with the description, serve to explain the principles of the invention. In the drawings, FIG. 1 schematically shows a circuit block diagram of a preferred embodiment according to the present invention;

FIG. 2 schematically shows a circuit block diagram of an error provision device of another preferred embodiment according to the present invention;

DETAILED DESCRIPTION

Figure 1:
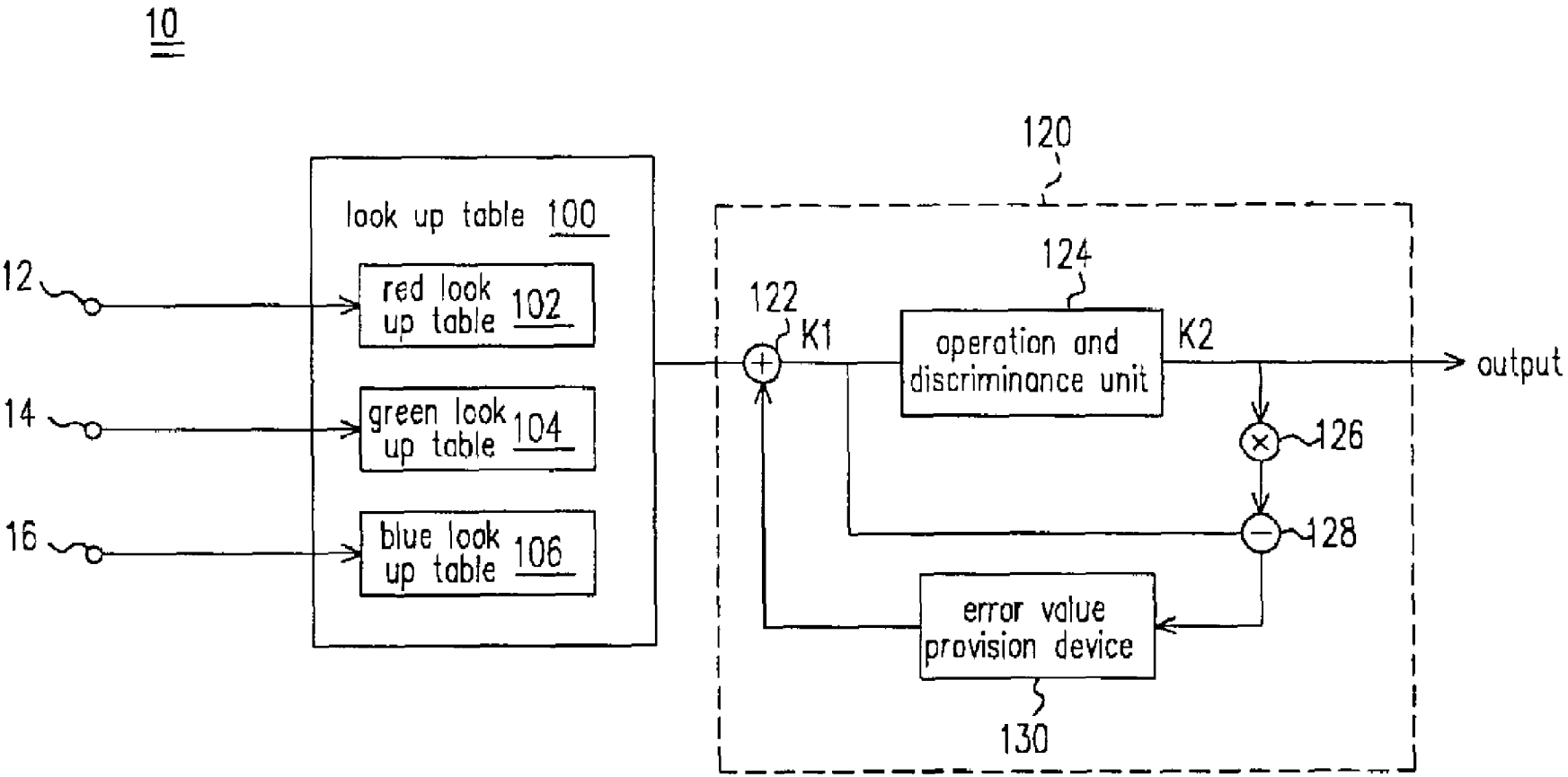
Figure 7:
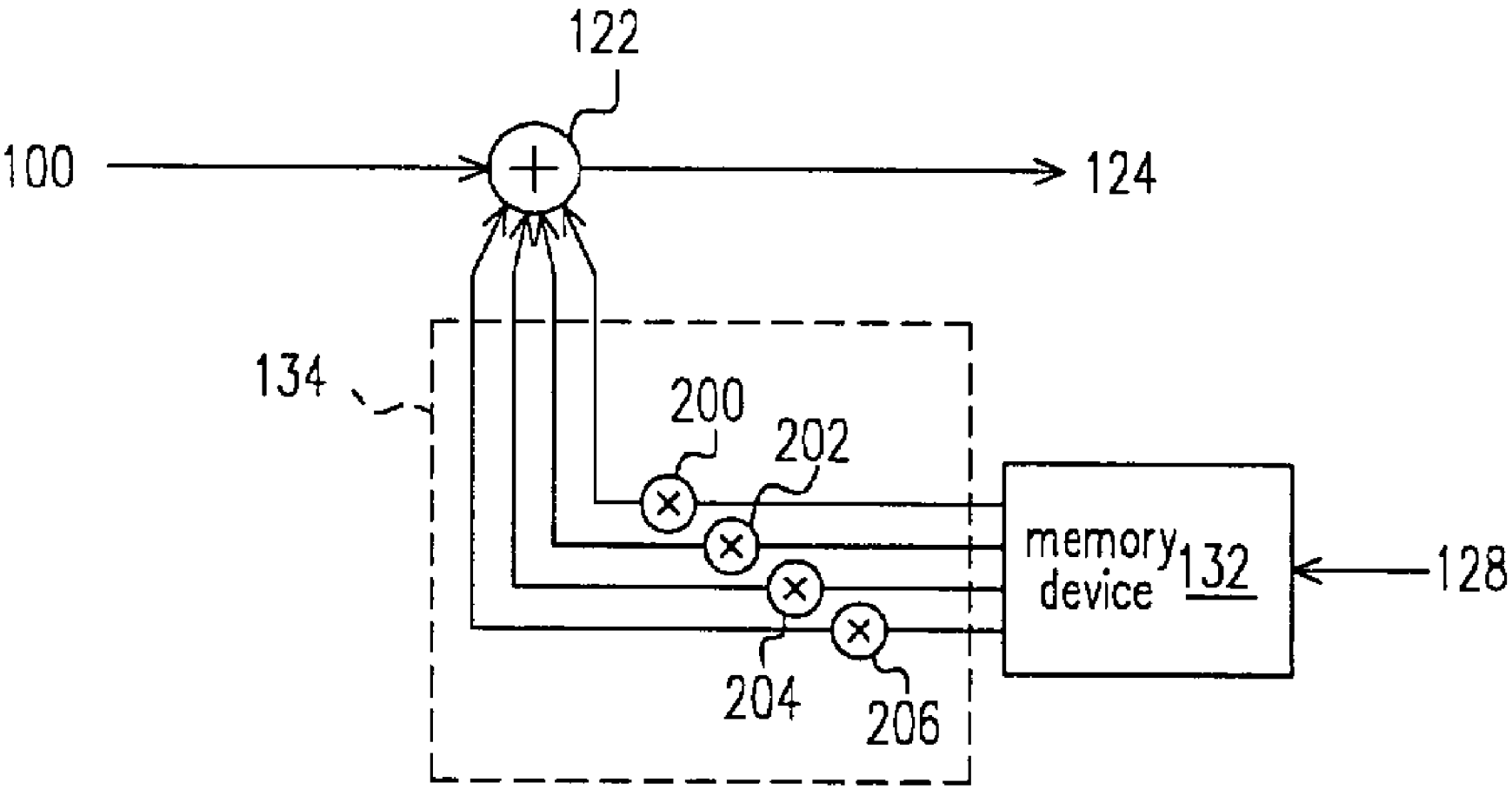

FIG. 1 schematically shows a circuit block diagram of a preferred embodiment according to the present invention. The color adjustment device 10 provided by the present embodiment comprises a Look Up Table (LUT) 100 and an Error Diffusion circuit 120. The LUT 100 provides a corresponding look up table to each of the three primitive colors, respectively Red LUT 102, Green LUT 104, and Blue LUT 106. The Red gray scale input value, the Green gray scale input value, and the Blue gray scale input value are input into the LUT 100 from the input terminal 12, 14 and 16 respectively. The corresponding gray scale value is found in Red LUT 102, Green LUT 104, and Blue LUT 106 respectively, and is subsequently output to the error diffusion circuit 120. To be noted, although the LUT 100 in the present embodiment only has one output signal for outputting the gray scale value to the error diffusion circuit 120, this does not serve as the essential limitation condition to the present invention. It is known by those who are skilled in the related art that the gray scale display of three primitive colors can be processed in parallel.

In present embodiment, the error diffusion circuit 120 comprises an adder 122, an operation and discriminance unit 124, a multiplier 126, a subtractor 128, and an error value provision device 130. Wherein, the adder 122 adds the gray scale value output from the LUT 100 to an error value output from the error value provision device 130 to obtain a value (k1), and the value k1 is output to the operation and discriminance unit 124 and the subtractor 128 respectively. The value k1 output to the operation and discriminance unit 124 is first divided by a predetermined value, and the integer portion of the quotient from the division operation is output as the value k2 shown in FIG. 1. In addition to being used as the brightness of the present pixel and to be output to the display control circuit (not shown in the diagram) of the display, the value k2 is also sent to the multiplier 126 to multiply it by the predetermined value that was used to divide the value k1 before. The value after the multiplication operation of the multiplier 126 is output to the subtractor 128 to subtract it from the value k1, and the value after the subtraction is output to the error value provision device 130 as a foundation of the error value that is needed to display the other pixels.

FIG. 2 schematically shows an internal circuit block diagram of an error provision device 130 of a preferred embodiment as shown in FIG. 1. In the present embodiment, the error value provision device 130 comprises a memory device 132 and a weighting element 134. The memory device 132 receives and stores a value sent from the subtractor 128. The values stored in the memory device 132, after the weighting process of the weighting element 134, become error values that are provided to the adder 122 as mentioned above.

The description mentioned above only provides the circuit connection method of the color adjustment device for the plasma display panel. In order to have those who are skilled in the related art have better understanding of the operation method of the present invention the flow chart as shown in FIG. 3 combined with the circuit shown in FIG. 1 and FIG. 2 are accompanied by the physical values for detailed description.

Figure 3:
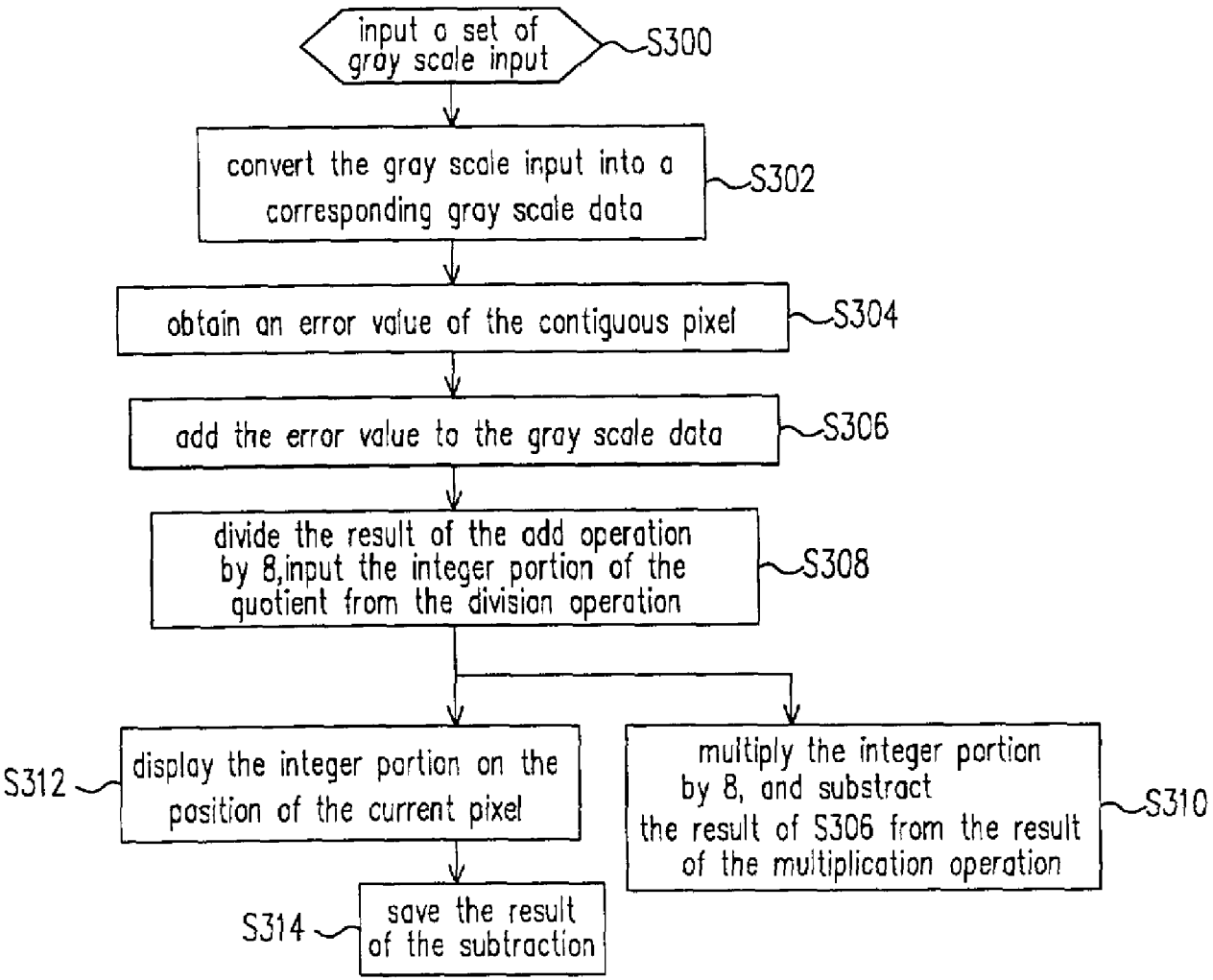
FIG. 3 schematically shows a flow chart of the operation steps of a further preferred embodiment according to the present invention.

Referring to FIG. 1 through FIG. 3, FIG. 3 schematically shows a flow chart of the operation steps of a further preferred embodiment according to the present invention. At first, assume the gray scale input value input from the input terminal 12, 14 and 16 by the pattern generator is falling in 0~255. The gray scale input value input by the pattern generator can only be the integer due to the characteristics of the pattern generator. Therefore, the values needed to be stored in the LUT 100 are the 256 gray scale data that correspond to each of the primitive colors (Red, Green, and Blue). Since the process methods for each of the three primitive colors are quite similar, the only difference among them is that the LUT of different primitive colors may have different corresponding relationships. Therefore, the present embodiment only describes the red primitive color hereinafter for detailed description.

Since the gray scale input value input from the input terminal 12 falls in 0~255, Red LUT 102 has to provide 256 corresponding integer values as the corresponding gray scale data. Here, it is assumed that the corresponding gray scale data is obtained by adding the gray scale input value to a value of 256. That is, the gray scale input value 0 corresponds to the gray scale data 256, the gray scale input value 1 corresponds to the gray scale data 257, . . . , and the gray scale input value 255 corresponds to the gray scale data 511. It is assumed that the range of the red brightness to be adjusted is 32~63. Since one of the objectives of the present invention is to enhance the color adjustment precision, the number of the integers included in the brightness range to be adjusted must be less than the number of integers included in the gray scale data, and thus the needed effect can be achieved.

It is assumed that the red gray scale input value input from the input terminal 12 is 4 (step S300), via the conversion of the Red LUT 102, the corresponding gray scale data is obtained as 260 (step S302). Moreover, the gray scale data (260) is output from LUT 100 to the adder 122 in the error diffusion circuit 120 to perform the add operation. Here it is the case for the first pixel only, since it is not necessary to consider the impacts caused by the display error of other pixels, the error value provided by the error value provision device 130 is 0 (step S304), and therefore the value k1 equals to 260 (step S306). Furthermore, the gray scale data 256~511 is used to adjust the brightness with a range of 32~63. With this, when the value k1 is operated in the operation and discriminance unit 124, the input value k1 is divided by 8, and the integer portion of the quotient after the division operation is subsequently output (step S308). In the present embodiment, the quotient of the value k1 (260) divided by 8 is 32.5, so the value k2 output from the operation and discriminance unit 124 is the integer portion (32) of this quotient.

The value 32 output from the operation and discriminance unit 124 is used as the brightness of the pixel that is displayed on the position of the current pixel (step S310), on the other hand, this value 32 is multiplied by 8 in the multiplier 126, and the value k1 (260) is subtracted from the result of the multiplication operation (256) (step 5312). The result of the subtraction (4) is stored in the error value provision device 130 (step S314).

The description mentioned above is the case when the pixel displayed is the first display point. Hereinafter, FIG. 4 is merged and referred to for further description of the operation to display other pixels.

Figure 4:
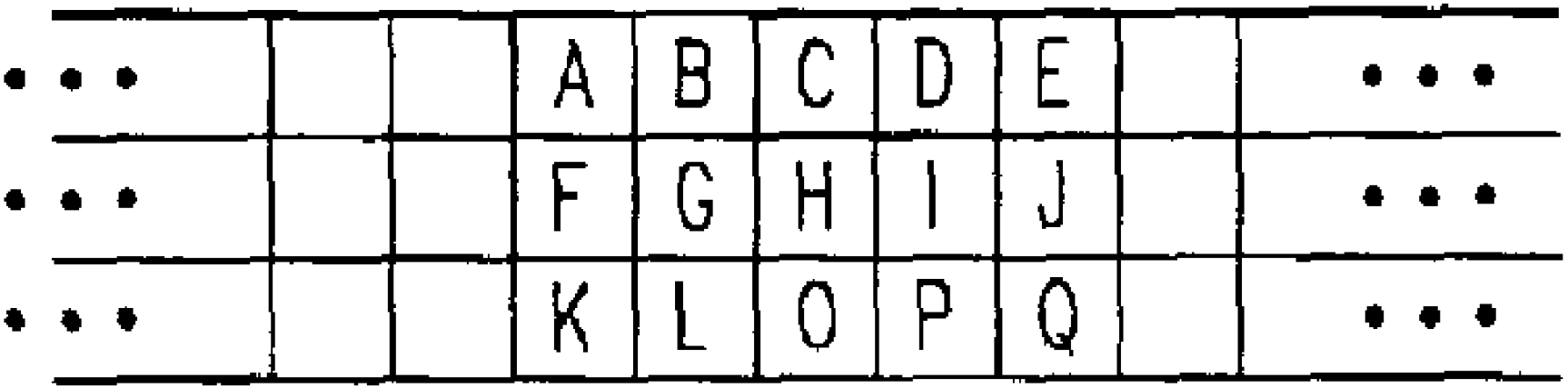
FIG. 4 schematically shows a sketch map of the pixel arrangement on the screen.

FIG. 4 schematically shows a sketch map of the pixel arrangement on the screen. Please also refer to the circuit shown in FIG. 2 as a foundation of the description. In FIG. 2, the weighting element 134 comprises four multipliers; they are multiplier 200, 202, 204 and 206. The value that is multiplied by these four multipliers (it is assumed as a, b, c and d) can be determined by those who are skilled in the related art. However, the summation of these values must equal to 1. Moreover, the reason for using the multiplier 200, 202, 204 and 206 to constitute the weighting element 134 is that the contiguous four pixels are the ones that really impact the brightness of the pixel currently displayed based on the consideration of the present embodiment.

For example, when point G in FIG. 4 is to be displayed, the previously obtained value from the subtractor 128 when point A, B, C and F are displayed has to be considered(this value is called as the error store value of A, B, C and F respectively). Similarly, when point P in FIG. 4 is to be displayed, it is needed to obtain the error store value generated by displaying point H, I, J and O. A weighting operation is applied to these error store values by the multiplier 200, 202, 204 and 206 respectively to determine the impact level that the contiguous pixel of each considered range impacts onto the pixel that is currently displayed. In the present embodiment, the summation of the values from the weighting operation by the multiplier 200, 202, 204 and 206 is the error value mentioned above.

Moreover, it has to be noted that the present invention is not limited to only consider the impact of four contiguous pixels. Those who are skilled in the related art can determine the number of the pixels as long as it is in the allowable memory storage range. For example, the impact of three contiguous pixels can also be considered, thus the weighting element 134 in FIG. 2 can only use three multipliers. It is also possible to consider the impact of five contiguous pixels. However, in such case the weighting element 134 in FIG. 2 has to use five multipliers.

Furthermore, since the gray scale value range 256~511 is used to adjust the brightness range 32~63 in the present embodiment, the precision can approach to a value of ⅛, that is the level of 0.125. Those who are skilled in the related art can modify the range of the gray scale value and the range of the brightness to be adjusted as they like, to achieve different levels of the precision. For example, if the gray scale value range 512~767 is used to adjust the brightness range 32~63, the precision can approach to a value of 1/16.

In summary, the advantages of the present invention are briefly described as follows. The present invention uses a greater range gray scale value to adjust a less range brightness, and further assist with an error diffusion method, so that the average color of a display area can be expressed more precisely, and thus the color expression level of the plasma display panel can be significantly improved.

Although the invention has been described with reference to a particular embodiment thereof, it will be apparent to one of the ordinary skill in the art that modifications to the described embodiment may be made without departing from the spirit of the invention. Accordingly, the scope of the invention will be defined by the attached claims not by the above detailed description.

The invention claimed is:

1. A color adjustment device for a plasma display panel, comprising:

a look up table, wherein the look up table stores a plurality of gray scale data, selects a data from the plurality of gray scale data according to a received gray scale input value, then outputs the selected gray scale data; and an error diffusion circuit, receiving the selected gray scale data output from the look up table to perform an error adjustment, wherein the error diffusion circuit comprises:

an error value provision device, providing an error value;

an adder, adding the gray scale data to the error value for performing an add operation, and outputting a first data that is obtained from the add operation;

an operation and discriminance unit, receiving the first data, dividing the first data by a predetermined value to obtain a quotient, and outputting an integer portion of the quotient;

a multiplier, multiplying the integer portion of the quotient by the predetermined value and outputting a result value from the multiplication; and a subtractor, receiving an output from the multiplier, subtracting the first data from the output of the multiplier, providing a second data that is obtained from the subtraction to the error value provision device.

2. The color adjustment device for the plasma display panel of claim 1, wherein the error value provision device further comprises:

a memory device, storing the second data provided by the subtractor, and outputting a portion of data that corresponds to a pixel related to a pixel to be displayed from the data that is stored; and a weighting element, performing a weighting operation onto the data output from the memory device to obtain the error value, providing the error value to the adder.

3. A color adjustment method for a plasma display panel, comprising the steps of:

receiving a gray scale input value that is within a first range;

converting the gray scale input value into a gray scale data that is greater than the gray scale input value, moreover the gray scale data is within a second range;

adding an error value to the first gray scale data to generate a second gray scale data;

dividing the second gray scale data with a predetermined value and obtaining an integer portion of a quotient from the division operation; and displaying a brightness that is the integer portion of the quotient from the division operation, which is within a third ranges, wherein the error value is generated according to the integer portion of the quotient from the division operation and the second gray scale data.

4. The color adjustment method for the plasma display panel of claim 3, wherein the step of converting the gray scale input value into the gray scale data further comprises:

looking up a value from a look up table corresponding to the gray scale input value and adding the value obtained from the look up table to the error value to obtain the gray scale data.

5. The color adjustment method for the plasma display panel of claim 3, wherein a maximum integer of the third range is an integer portion of a quotient from a maximum integer of the second range divided by a predetermined value.

6. The color adjustment method for the plasma display panel of claim 3, wherein the step of displaying the gray scale data as the brightness that is within the third range by using the error diffusion method further comprises:

obtaining the error value after an error store value of a contiguous pixel multiplied by a weighting value;

dividing a value of the result of adding the gray scale data to the error value by a predetermined value, and obtaining an integer portion of a quotient from the division operation;

displaying the brightness with the integer portion on a current pixel;

subtracting a value of the result of the integer portion multiplied by the predetermined value from the gray scale data, storing a value obtained from the subtraction operation; and using the value as the error store value of the current pixel.

7. A color adjustment method for a plasma display panel, comprising the steps of:

receiving a gray scale input value that is an integer;

converting the gray scale input value into a corresponding gray scale data; and adjusting a brightness display according to the gray scale data;

wherein, the gray scale input value has a one-to-one corresponding relationship to the gray scale data, moreover if a range that gray scale data appears in comprises N integers and a brightness range to be adjusted comprises M integers, then N>M, wherein the step of adjusting the brightness display according to the gray scale data further comprises:

obtaining the error value after an error store value of a contiguous pixel is multiplied by a weighting value;

dividing a value of the result of adding the gray scale data to the error value by a predetermined value, and obtaining an integer portion of a quotient from the division operation;

displaying the brightness with the integer portion on a current pixel;

subtracting a value of the result of the integer portion multiplied by the predetermined value from the gray scale data, storing a value obtained from the subtraction operation; and using the value as the error store value of the current pixel.

8. The color adjustment method for the plasma display panel of claim 7, wherein the gray scale data is obtained by looking up a value from a look up table corresponding to the gray scale input value and adding the value obtained from the look up table to the error value.

9. A color adjustment method for a plasma display panel, comprising the steps of:

receiving a gray scale input value that is within a first range;

converting the gray scale input value into a gray scale data that is greater than the gray scale input value, moreover the gray scale data is within a second range; and displaying the gray scale data as a brightness that is within a third range, wherein the number of integers in the third range is less than the number of integers in the second range and is determined by an error diffusion method using an error value, where the error value is obtained by an error store value of a contiguous pixel multiplied by a weighting value.

10. The color adjustment method for the plasma display panel of claim 9, wherein the gray scale input value is converted into the gray scale data by looking up a value from a look up table and adding the value obtained from the look up table to the error value.

11. The color adjustment method for the plasma display panel of claim 9, wherein a maximum integer of the third range is an integer portion of a quotient from a maximum integer of the second range divided by a predetermined value.

12. The color adjustment method for the plasma display panel of claim 9, wherein the error store value is obtained by:

dividing a value of the result of adding the gray scale data to the error value by a predetermined value, and obtaining an integer portion of a quotient from the division operation;

subtracting a value of the result of the integer portion multiplied by the predetermined value from the gray scale data to obtain the error store value of the current pixel.

* * * * *